US009441641B1

(12) United States Patent
Criswell

(10) Patent No.: US 9,441,641 B1
(45) Date of Patent: Sep. 13, 2016

(54) FIREFIGHTER'S FAN, KIT AND METHOD

(71) Applicant: Wayne Criswell, East Fallowfied, PA (US)

(72) Inventor: Wayne Criswell, East Fallowfied, PA (US)

( * ) Notice: Subject to any disclaimer, the term of this patent is extended or adjusted under 35 U.S.C. 154(b) by 385 days.

(21) Appl. No.: 14/208,073

(22) Filed: Mar. 13, 2014

Related U.S. Application Data

(60) Provisional application No. 61/790,769, filed on Mar. 15, 2013.

(51) Int. Cl.
*F04D 29/60* (2006.01)
*F04D 29/64* (2006.01)
*A62C 8/00* (2006.01)

(52) U.S. Cl.
CPC ..... *F04D 29/646* (2013.01); *A62C 8/00* (2013.01)

(58) Field of Classification Search
CPC . A62C 3/0207; A62C 3/0214; F04D 19/002; F04D 25/08; F04D 25/12; F04D 29/646; F04D 29/52; F04D 29/522; F04D 29/60; F04D 29/32; F04D 29/40; F04D 29/325; F04D 29/601; F04D 29/26; F04D 19/00
USPC ..... 169/91, 51, 57, 52, 67; 269/55, 71; 415/213.1
See application file for complete search history.

(56) References Cited

U.S. PATENT DOCUMENTS 4,039,129 A * 8/1977 Berkeland ..... F04D 29/646 248/211
4,258,895 A * 3/1981 Rorie ..... F16M 13/00 248/317

* cited by examiner

*Primary Examiner* — Eric Keasel
*Assistant Examiner* — Jason Mikus
(74) *Attorney, Agent, or Firm* — Robert J. Yarbrough of Lipton, Weinberger & Husick

(57) ABSTRACT

A fan for use by firefighters includes a pair of brackets that are rotatably attached to the fan and rotatable among three position. In a first position, the bracket retains the side of the fan on a door. In a second position, hooks on the brackets allow the fan to hang from a support. In a third position, a bracket is stored and retains coiled electrical cable to the fan. The hooks selectably engage mating slots in a second fan, allowing two fans to be stacked. Extendable arms selectably retain the fan in an open window or doorway. The Invention is also a kit to retrofit an existing fan.

17 Claims, 26 Drawing Sheets

FIREFIGHTER'S FAN, KIT AND METHOD

I. STATEMENT OF RELATED APPLICATIONS

This application is entitled to priority from U.S. provisional patent application No. 61/790,769 by Wayne Criswell filed Mar. 15, 2013. Provisional application 61/790,769 is hereby incorporated by reference as if set forth in full herein.

II. BACKGROUND OF THE INVENTION

A. Field of the Invention

The invention is an improved fan for use by firefighters at a fire scene. The invention is a kit to retrofit a fan. The invention also is a method of ventilating a fire scene using the fan or kit of the invention.

B. Statement of the Related Art

Electrical fans are used to ventilate a fire scene to clear smoke from a building. A typical fan includes an axial rotary fan blade of about sixteen inches in diameter. The fan blade is turned by an electrical motor. The fan includes a cylindrical duct and two generally square exhaust and intake baffles at either end of the duct. Grills cover the ends of the duct. Corner rods are generally parallel to the axis of rotation of the fan blade and join the corners of the baffles. The rods provide handles by which the firefighter can carry and position the fan. The fans are powered through electrical cables, which also are carried by the firefighters. The firefighter frequently will store and carry the power cable by coiling the power cable and placing the coiled power cable on top of the circular duct and between the two baffles.

A prior art hook may be used to hang a fan from a support, such as an expandable bar. Expandable bars are used by firefighters to span doorways so that the firefighter may hang equipment from the expandable bar. For a prior art fan hook, one firefighter must hold and support the weight of the fan while another firefighter supports and engages the prior art hook, making installation of a fan a two-firefighter job.

III. BRIEF DESCRIPTION OF THE INVENTION

The firefighter's fan of the invention or a fan equipped with the kit of the invention includes three systems that can be installed and used in combination or separately. The first system is a pair of brackets each of which is rotatably and slidably attached to the fan. The second system is a pair of side plates defining gripping locations and each defining a stabilizing slot to allow stacking of two fans. The third system comprises extendable bars attached to the fan to retain the fan in a window or doorway.

Pair of Brackets

The pair of rotatable brackets allow the fan to be supported by a door from either the left side or right side of the fan. The pair of brackets also include a pair of hooks that allow the fan to be hung from an expandable bar or any convenient support and that also can engage stabilizing slots to allow two fans to be safely stacked one on top of the other.

Each of the brackets has a first arm and a second arm. The first and second arms are generally normal to each other and meet at an intersection. Each of the brackets is attached to the fan and defines a bracket axis of rotation that is located proximal to the intersection of the first and second arms and that is generally normal to the first and second arms. The first arm defines a door-engaging protrusion that is generally parallel to the second arm and in a spaced-apart relation to the second arm. The spaced-apart relation of the door-engaging protrusion and the second arm corresponds to the thickness of a door. The second arm of each bracket defines a hook. Each brackets may be rotated with respect to the fan about the axis of rotation among first, second and third positions. When the bracket is in the first position, the door-engaging protrusion is exposed on the left or the right side of the fan. When the bracket is in the second position, the hook is exposed on the top side of the fan. When the bracket is in the third position, neither the door-engaging protrusion nor the hook is exposed.

When a bracket, for example the bracket corresponding to the left side of the fan, is rotated to the first position, the door-engaging protrusion extends from the left side of the fan. When the first arm of the bracket is placed over the top of a door, the door-engaging protrusion of the bracket engages the back side of the door. The weight of the fan will cause the bracket to rotate about its axis of rotation, which will bring the second arm to bear against the front side of the door, clamping the left side of the fan to the front side of the door.

Attaching the left or right side of the fan to the front of the door allows the firefighter to direct the flow of air from the fan through a doorway and in any direction desired by the firefighter by moving the door about the door hinge. Hanging the fan on the door also removes the fan and its electrical connection from underfoot, removing a tripping hazard and increasing the safety of the fire environment for the firefighter. The bracket is self-supporting in the first position with the door-engaging protrusion protruding, so that a single firefighter can configure the fan to be hung from the door and can also hang the fan. In the prior art, hanging a firefighter's fan from a door is a two-person job.

When the brackets are rotated to the second position, the second arm of each bracket extends in an upward direction from the top side of the fan while the first arm does not extend from the fan. Each second arm defines a hook. The hooks allow the fan to be suspended from any convenient support, such as a prior art expandable bar. The hooks are self-supporting in the upright second position, unlike the prior art. Using the apparatus of the invention, a single firefighter can rotate the hook to the second position and can install the fan on an expandable bar or other suitable support, saving effort and time over the prior art.

When the brackets are in the second position, the two second arms extend above the top side of the fan and also allow two fans to be stacked one on top of the other. The second arms of the brackets of the lower fan in the stack slidably engage stabilizing slots defined by the upper fan in the stack. The engagement between the second arms and the stabilizing slots stabilizes the upper fan in the stack and prevents the upper fan from sliding with respect to the lower fan.

The two brackets are slidable with respect to the fan so that each bracket may be located proximal to the intake side of the fan, also referred to herein as the back side, proximal to the exhaust side of the fan, also referred to herein as the front side, and at intermediate positions between the intake and exhaust sides of the fan. The slidable engagement of the brackets and the fan allows the center of gravity of the fan to be adjusted with respect to the hooks and the door brackets, which allows the angle of the fan as supported by the hooks or by the first arm and door-engaging protrusion to be adjusted by the firefighter.

When the two brackets are rotated to the third position, neither the first nor the second arm extends from the fan and the brackets are in the stored position, allowing compact storage and transportation of the fan. The brackets in the third position assist in securing a coiled power cable to the top of the cylindrical duct. To place the power cable on the fan, the brackets are moved to the second position, which clears the storage location for the cable. The coiled cable is inserted on top of the cylindrical duct and between the front and back baffles and the brackets are moved to the third position, which blocks unintended escape of the coiled cable from the top of the cylindrical duct.

The bracket is adjustable, preferably by wing nuts, to allow the resistance to rotatable motion and the resistance to sliding motion of the bracket with respect to the fan to be adjusted by the user. The bracket also can be readily disassembled and assembled for installation and removal. The assembly comprises a first arm and a second arm. The second arm defines the hook and includes a key at the end distal to the hook. The second arm connects to the first arm by the key penetrating a slot defined by the first arm. The second arm and the first arm are maintained in engagement by two threaded fasteners, allowing adjustment of the compression applied by the second arm and the first arm and determining the force required to rotate or slide the bracket. The force applied by the fasteners also maintains the key in the slot, holding the distal end of the second arm in engagement with the first arm.

Side Plates

The second system comprises a pair of side plates that are attachable to opposing left and right sides of the fan. Each of the side plates defines one or more openings that serve as additional gripping locations for positioning and carrying the fan. Each of the side plates also has an angled portion defining a stabilizing slot that is proximal to the bottom side of the fan. The stabilizing slots are aligned so that when the hook of the second arm of a first fan is in the second, or upright, position, the stabilizing slots of a second fan can receive the hook, retaining the second fan on top of the first fan, with the hooks and stabilizing slots in engagement.

Extendable Bars

The third system comprises four extendable bars located proximal to the four corners at the top side of the fan. Each of the extendable bars can be extended to the left or right side of the fan and will resist motion toward the front or toward the back side of the fan; that is, in a direction parallel to the axis of rotation of the fan blade. The four extendable bars allow the fan to be placed on a window sill or in a doorway and for the extendable bars to be extended and placed in engagement with either side of the wall in which the window or doorway appears. The extendable bars stabilize the fan in the window or doorway, preventing the fan from falling from the window sill or doorway. Depending on the architectural features of the building, all four bars may be deployed so that the fan is prevented from falling either into or out of the building. Alternatively, two of the bars may be deployed.

Any design for the bars is contemplated by the invention, including without limitation rotatable bars, telescoping bars, extendable bars and removable bars. For rotatable bars, the bars may each feature a hinge proximal to a corner of the fan. In the stored, or closed position, the bar is maintained in position by a clevis pin or other apparatus known in the art at the end of the bar distal to the hinge. To move to the open, or deployed position, the clevis pin holding the bar in the closed position is removed and the bar rotated about 180 degrees to the deployed position. Another clevis pin holds the bar in the open position.

IV. BRIEF DESCRIPTION OF THE DRAWINGS

Figure 12:
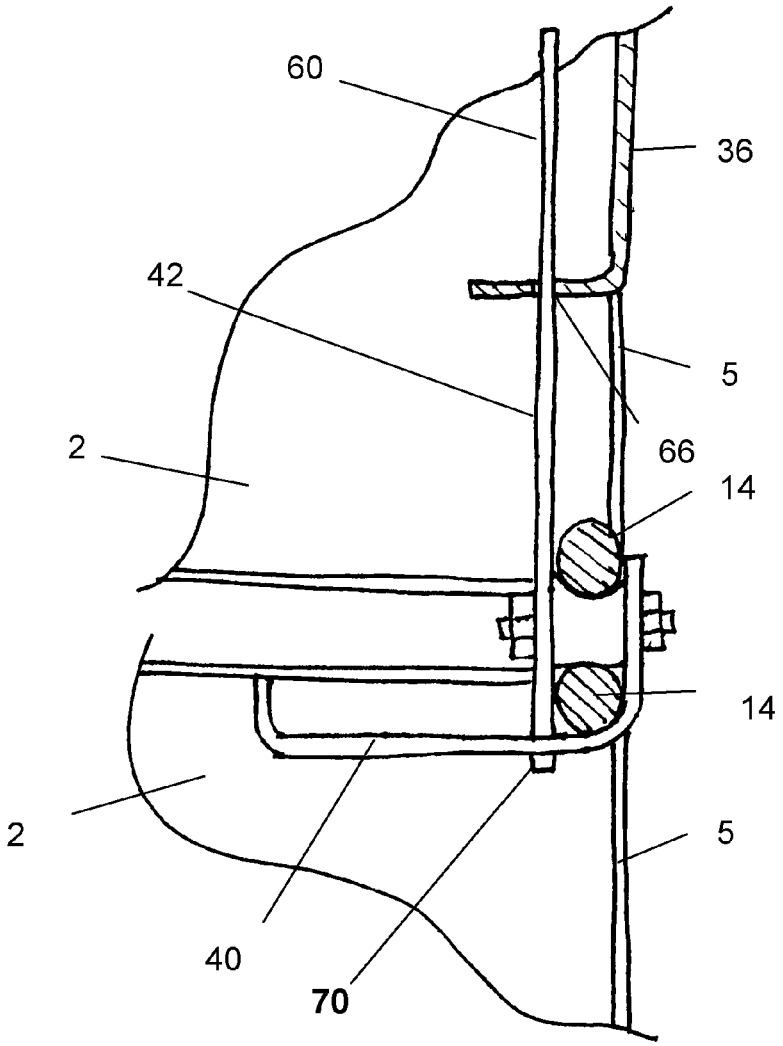

FIG. 12 detail cutaway view of the two stacked fans.

Figure 13:
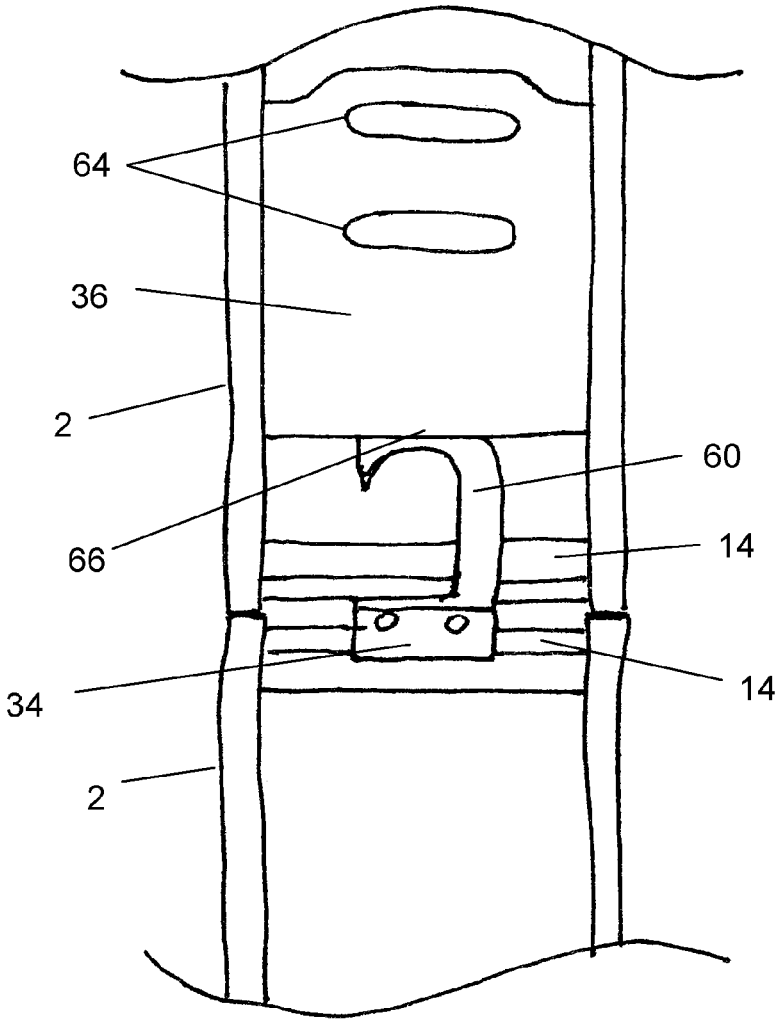

FIG. 13 is a side view of the two stacked fans.

Figure 14:
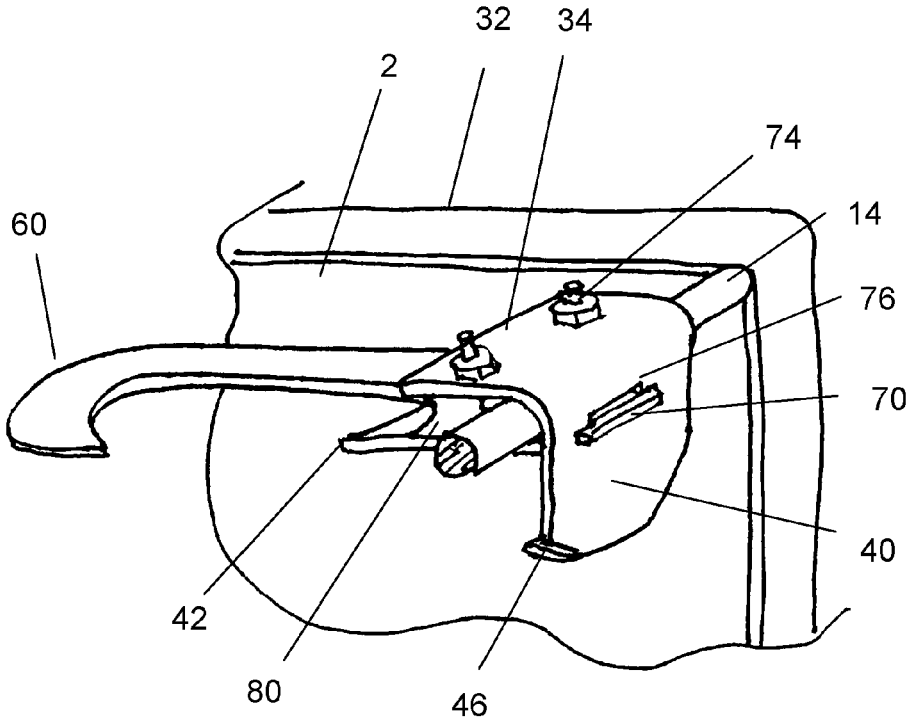

FIG. 14 is a detail perspective view of the bracket in the third position.

Figure 15:
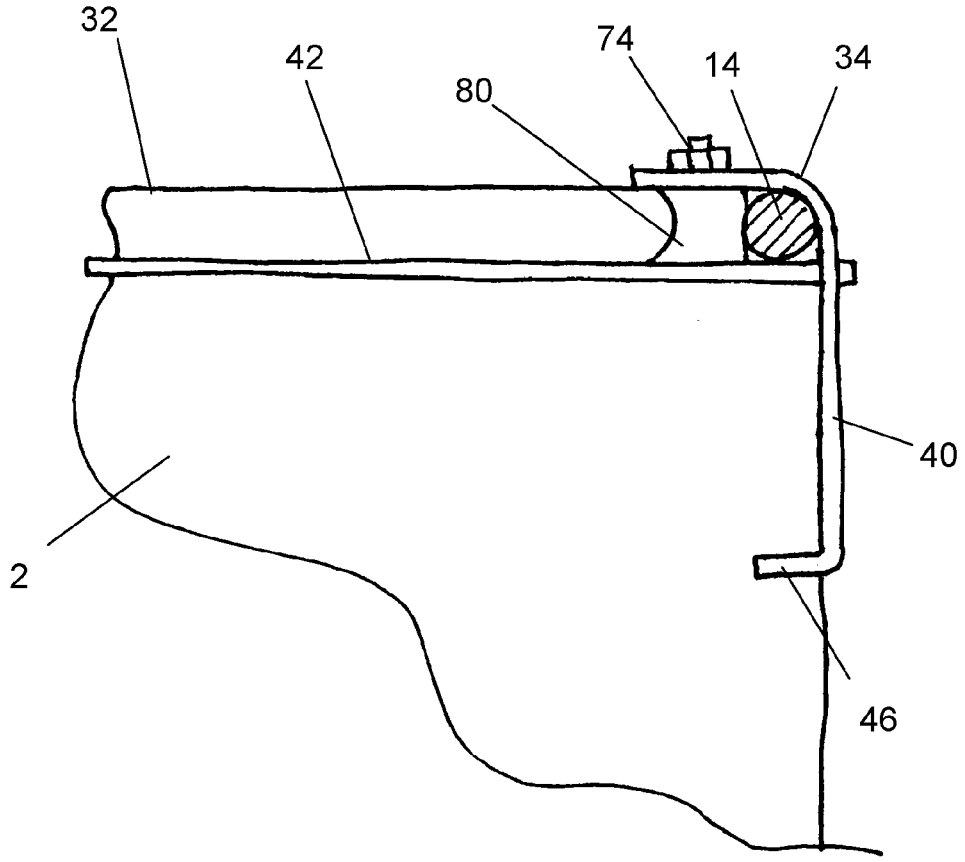

FIG. 15 is a detail section view of the bracket in the third position.

Figure 16:
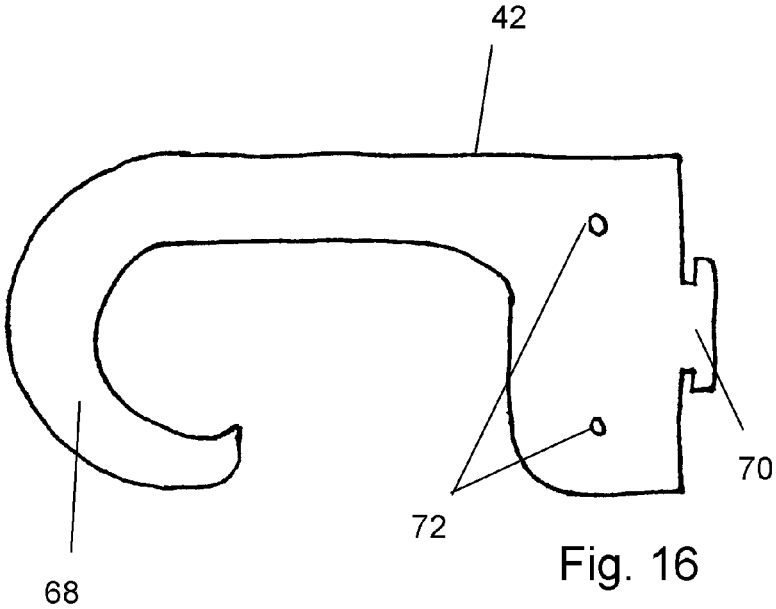

FIG. 16 is a side view of the second arm.

Figure 17:
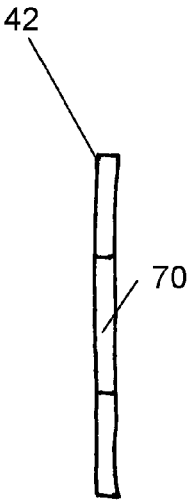

FIG. 17 is an end view of the second arm.

Figure 18:
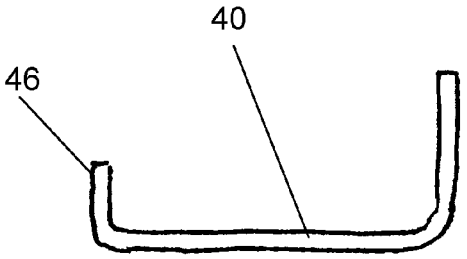

FIG. 18 is a side view of the first arm.

Figure 19:
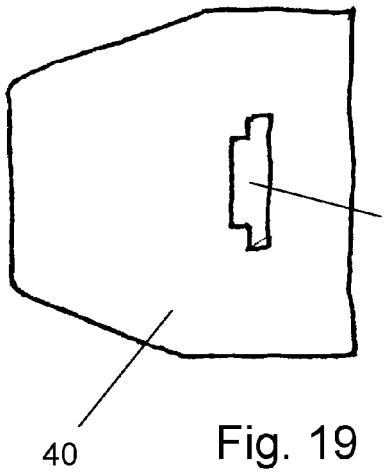

FIG. 19 is a plan view of the first arm.

Figure 20:
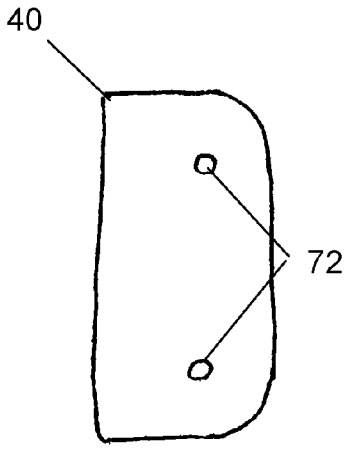

FIG. 20 is an end view of the first arm.

Figure 21:
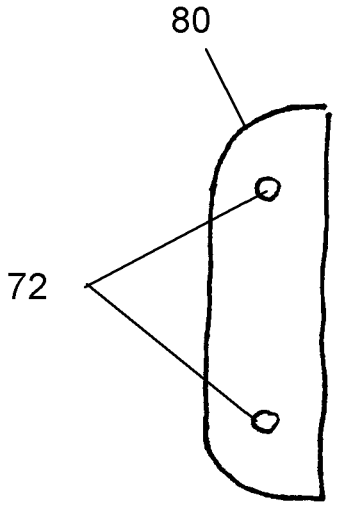

FIG. 21 is a side view of a spacer.

Figure 22:
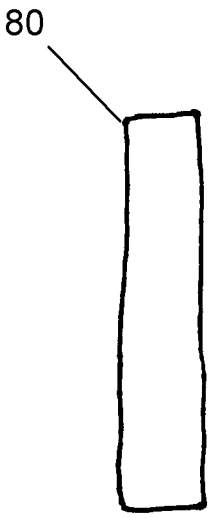

FIG. 22 is a bottom view of the spacer.

Figure 23:
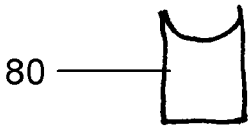

FIG. 23 is an end view of the spacer.

Figure 24:
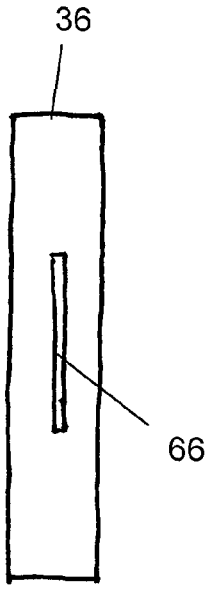

FIG. 24 is an end view of the side plate.

Figure 25:
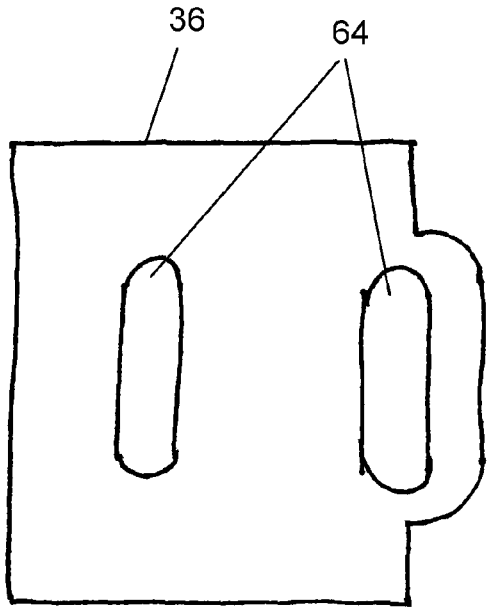

FIG. 25 is a top view of the side plate.

Figure 26:
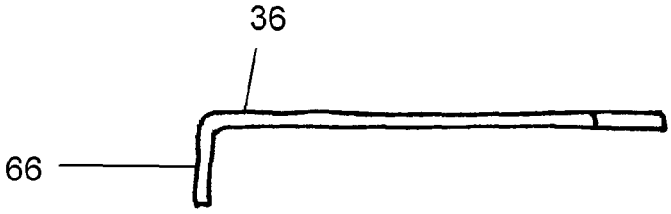

FIG. 26 is a side view of the side plate.

Figure 27:
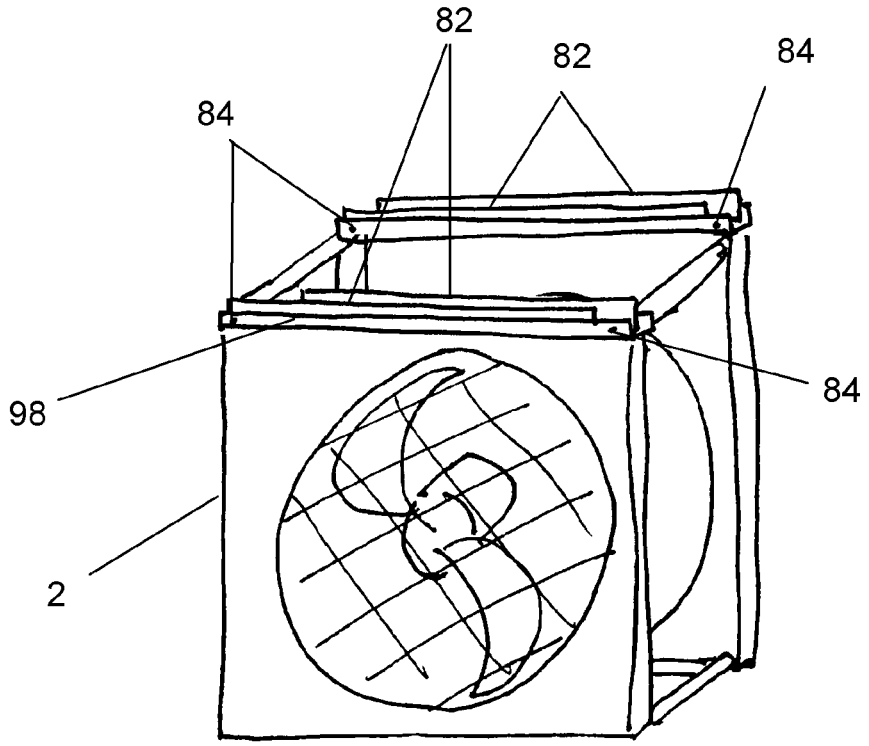

FIG. 27 is a perspective view of a fan equipped with extendable arms in the stored position.

Figure 28:
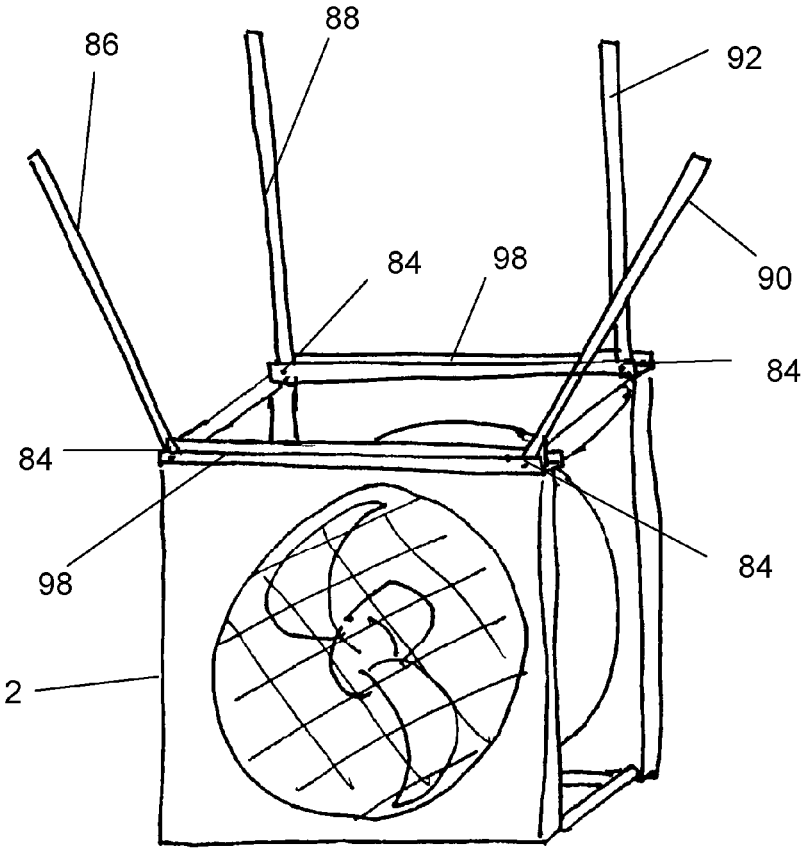

FIG. 28 is a perspective view of a fan equipped with extendable arms with the arms in the process of being deployed.

Figure 29:
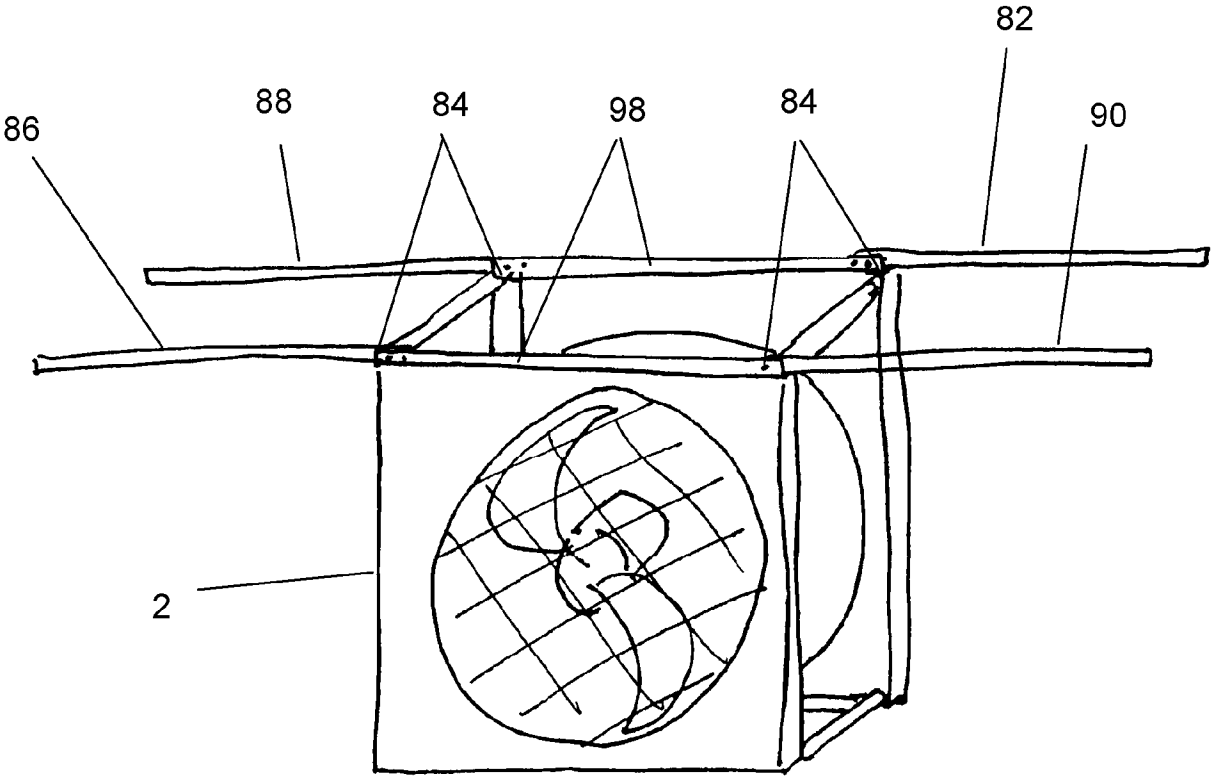

FIG. 29 is a perspective view of the fan with arms in the deployed position.

Figure 30:
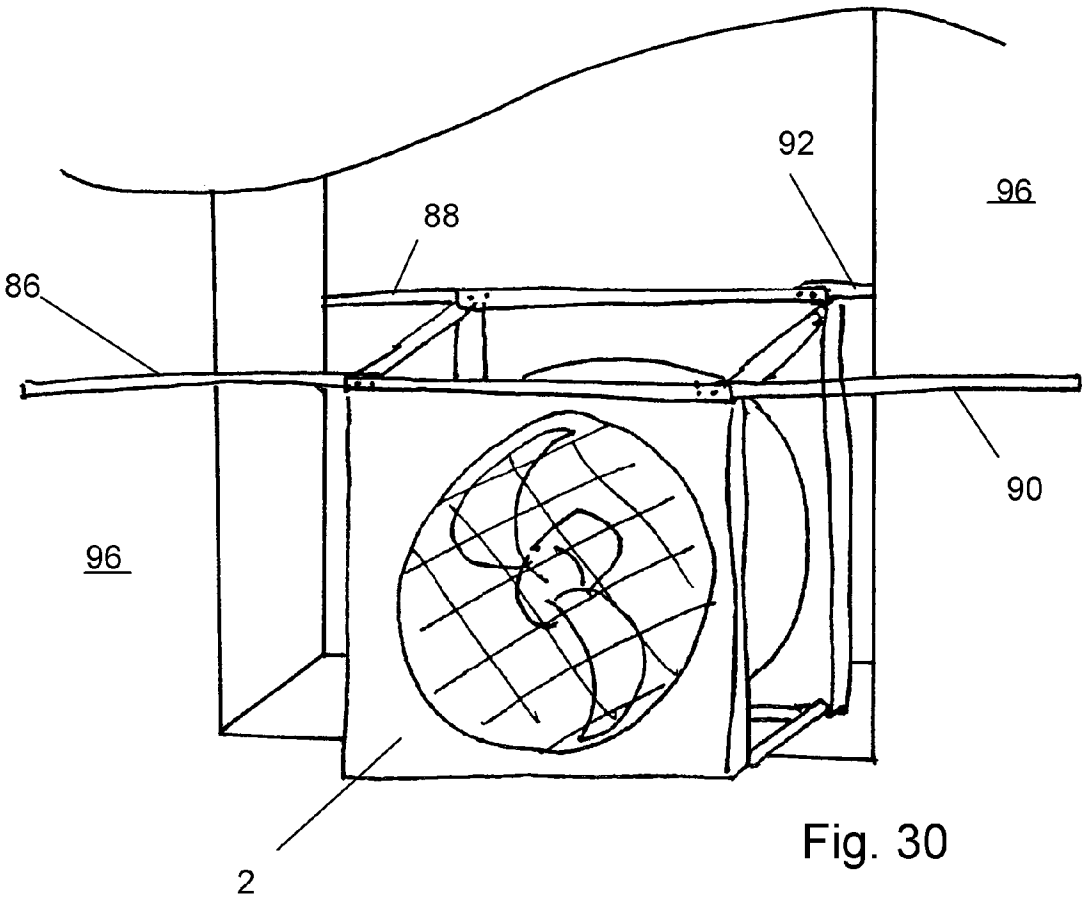

FIG. 30 is a perspective view of the fan supported by a window sill with the extendable arms preventing the fan from falling from the window sill.

Figure 31:
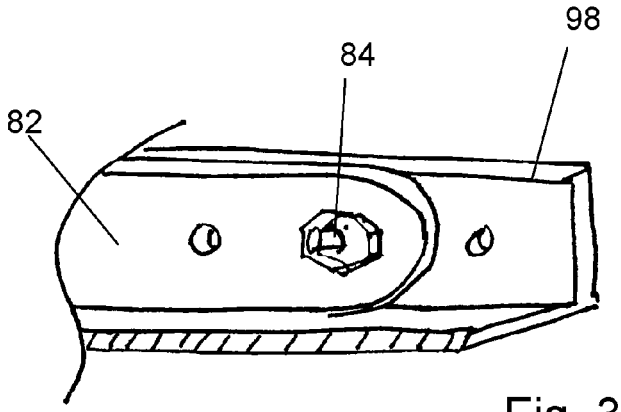

FIG. 31 is a detail cutaway of the extendable arm in the stored position.

Figure 32:
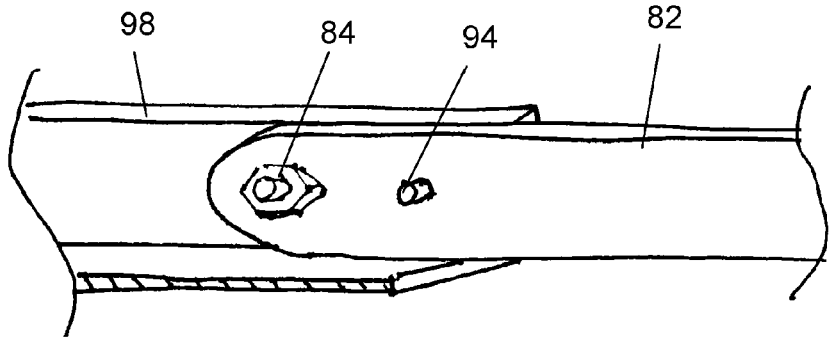

FIG. 32 is a detail cutaway of the extendable arm in the deployed position.

Figure 33:
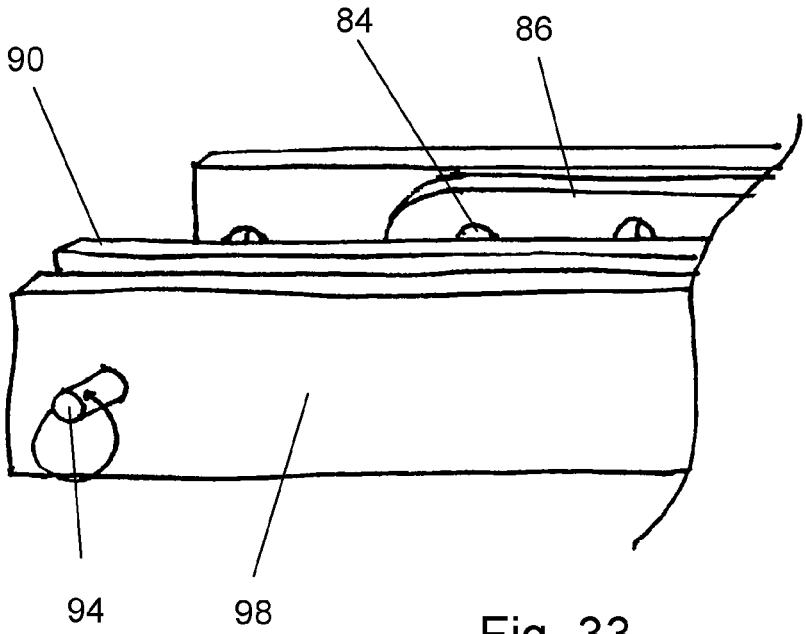

FIG. 33 is a detail of the extendable arm in the stowed position.

Figure 34:
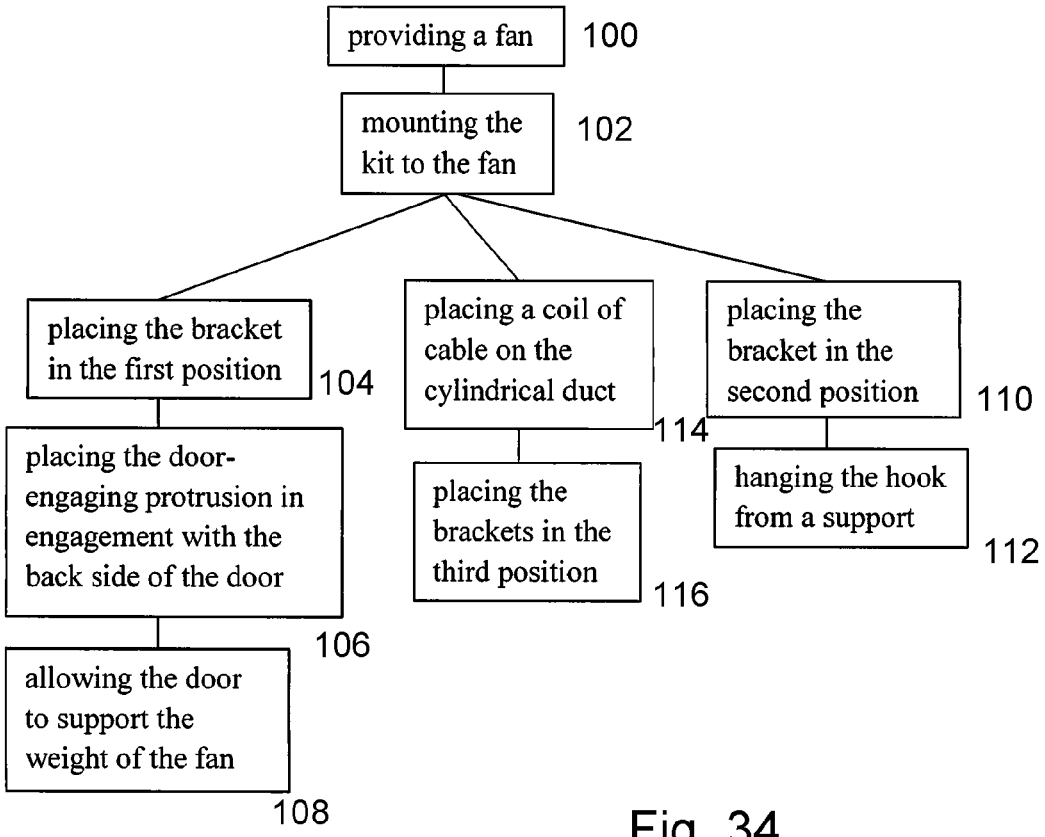

FIG. 34 is a flow chart of a method of the Invention.

Figure 35:
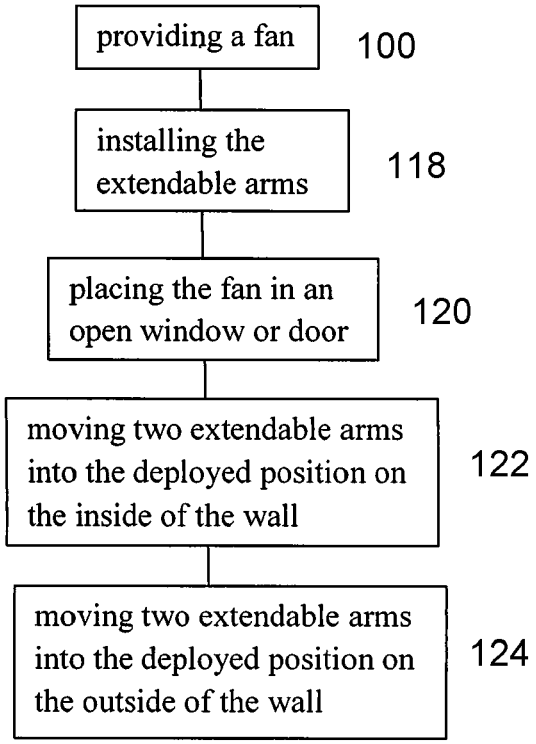

FIG. 35 is a flow chart of a method of the Invention.

V. DESCRIPTION OF AN EMBODIMENT

Figure 1:
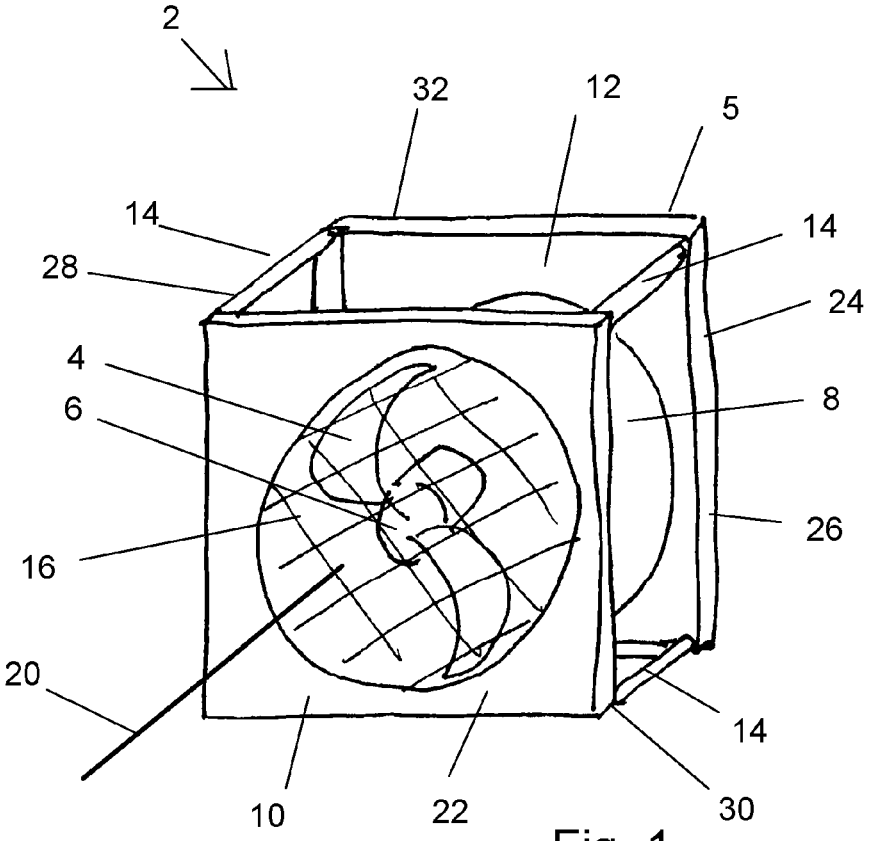
Fig. 1 Prior Art
FIG. 1 is a perspective view of a prior art fan.

FIG. 1 shows a prior art fan 2. The fan 2 includes an axial blade 4 and an electrical motor 6 to drive the fan blade 4. The fan 2 has a fan frame 5 that includes a cylindrical duct 8, an intake baffle 12 and an exhaust baffle 10. Rod-shaped members 14 are disposed at the corners of the intake and exhaust baffles 12, 10 and join the front and back sides of the fan 2. Grills 16 are disposed at the ends of the duct 8. The fan 2 has a fan axis of rotation 20. The fan 2 has a front side 22 from which the fan 2 discharges air, a back side 24 into which the fan 2 intakes air, a left side 26, an opposing right side 28, a bottom side 30 and a top side 32.

Figure 2:
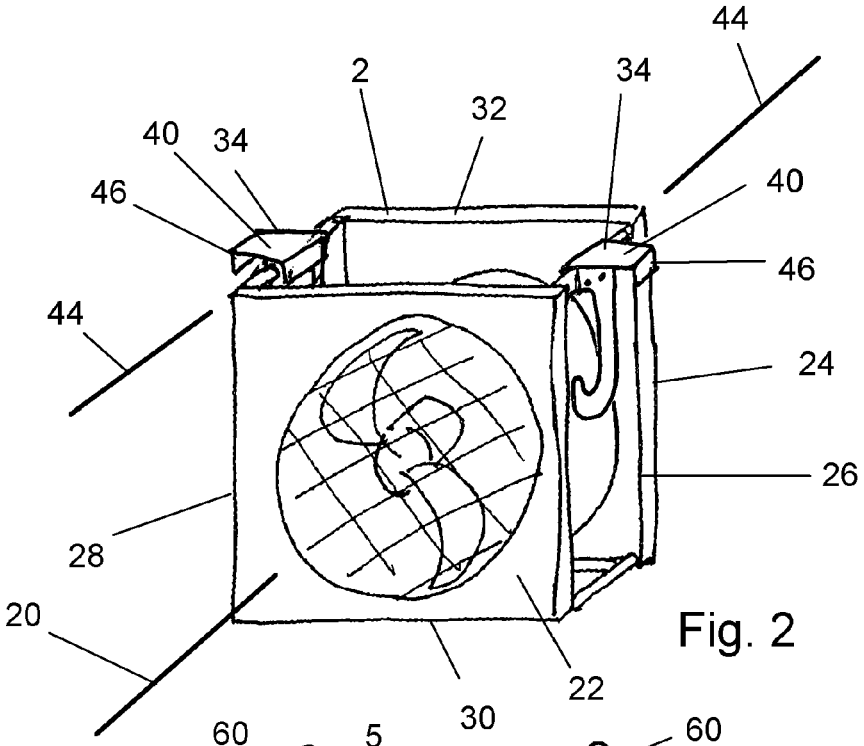
FIG. 2 is a perspective view of a fan equipped with the brackets and with the brackets in the first position.
Figure 3:
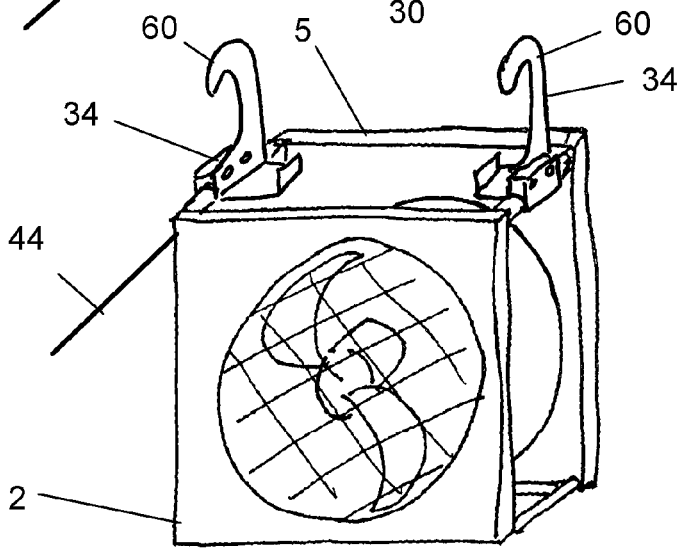
FIG. 3 is a perspective view of the fan with the brackets in the second position.
Figure 4:
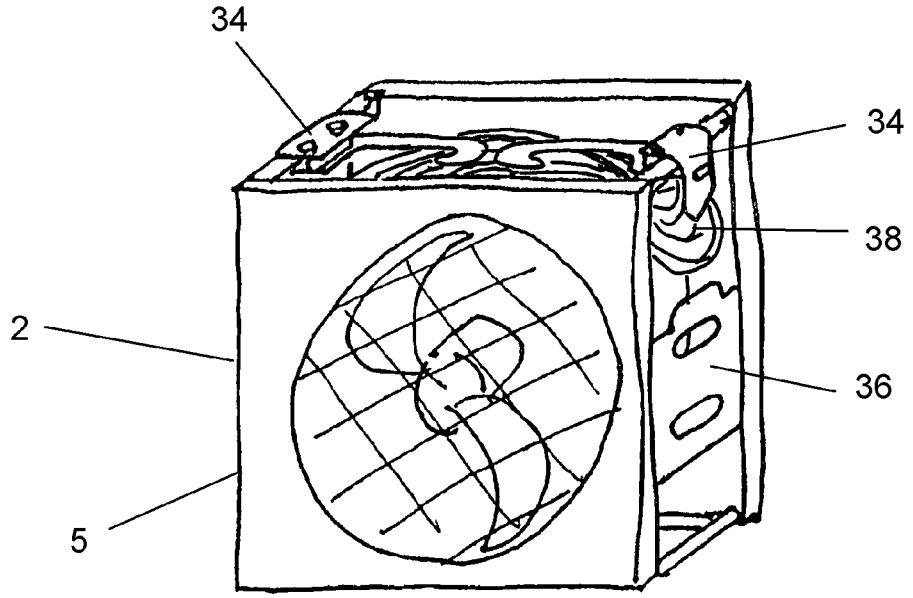
FIG. 4 is a perspective view of the fan with the brackets in the third position.

FIGS. 2, 3 and 4 are perspective views and show a fan 2 equipped with brackets 34. The brackets 34 are rotatably attached to the rod-shaped members 14 proximal to the top side 32 of the fan 2. The brackets 34 are rotatable about bracket axes of rotation 44 between first, second and third positions. The bracket axes of rotation 44 coincide with the longitudinal axes of the rod-shaped members and are generally parallel with the fan axis of rotation 20. The brackets 34 are shown as in the first position in FIG. 2, in the second position in FIG. 3 and in the third position in FIG. 4. A pair of the brackets 34 are disposed on either side of the fan 2. Each of the pair of brackets 34 are mirror images of the other of the pair of brackets 34.

Figure 5:
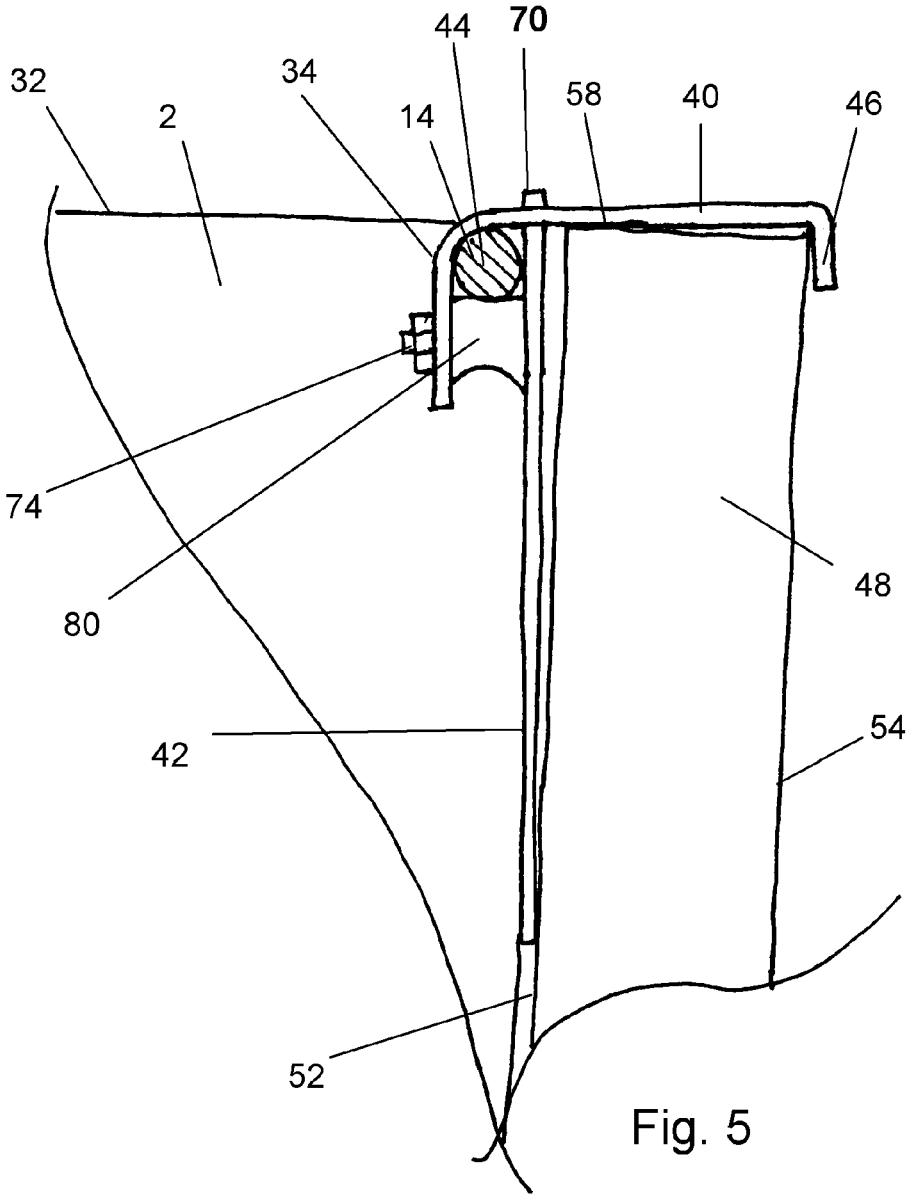
FIG. 5 is a side partial section view of the door-engaging protrusion in place on a door.
Figure 6:
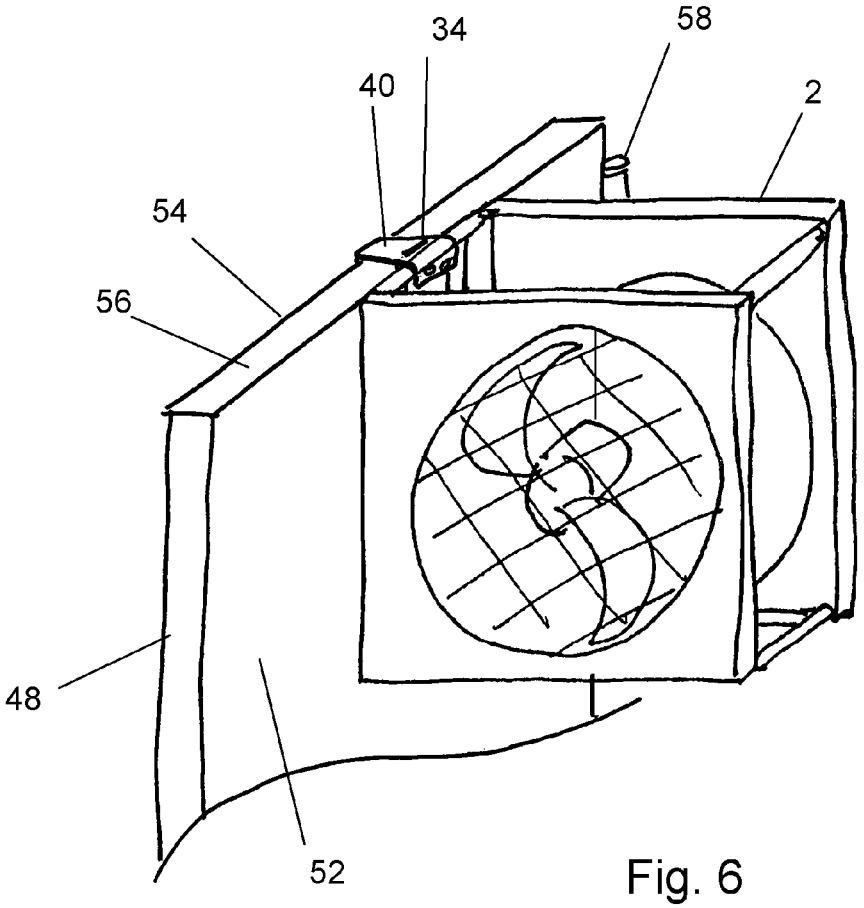
FIG. 6 is a perspective view of the first arm supporting the fan on a door.

FIGS. 2, 5 and 6 illustrate the bracket 34 in the first position. FIG. 5 is a perspective view of the fan 2 with the brackets 34 in the first position. FIG. 5 is a detail cross section of the fan 2 and bracket 34 in the first position. FIG. 6 is a perspective view of the fan 2 clamped to a door 48 by the bracket 34 in the first position.

From FIG. 5, the bracket 34 has a first arm 40 and a second arm 42. First and second arms 40, 42 are attached one to the other and are generally normal one to the other. The first and second arms 40, 42 are attached proximal to the bracket axis of rotation 44. The first arm 40 defines a door-engaging protrusion 46 that is generally normal to the second arm 42 and in a spaced-apart relation to the second arm 42. The door-engaging protrusion is generally parallel to the second arm and extends from the first arm 40 in the same direction as the second arm 42. The spaced-apart relation of the door-engaging protrusion 46 and the second arm 42 corresponds to the thickness of a door 48. The door has a back side 54, a front side 52, and a top side 58.

As shown by FIGS. 5 and 6, when the bracket 34 is rotated to the first position and the first arm 40 is placed in engagement with the top side 58 of the door 48, the door-engaging protrusion 46 engages the back side 54 of the door 48. The weight of the fan 2 causes the fan 2 to move downward and causes the bracket 34 to rotate about the bracket axis of rotation 44. The second arm presses against the front side 52 of the door 48, clamping the left or right side 26, 28 of the fan 2 to the front side 52 of the door 48. Because two brackets 34 are used, with a bracket 34 proximal to both the left and right sides 26, 28 of the fan 2, either the left or right sides 26, 28 of the fan 2 may be attached to the door 48. The door 48 is supported by a door hinge 58. The door hinge 58 allows the firefighter to direct the flow of air from the fan 2 by rotating the door 48 about the door hinge 58.

Figure 7:
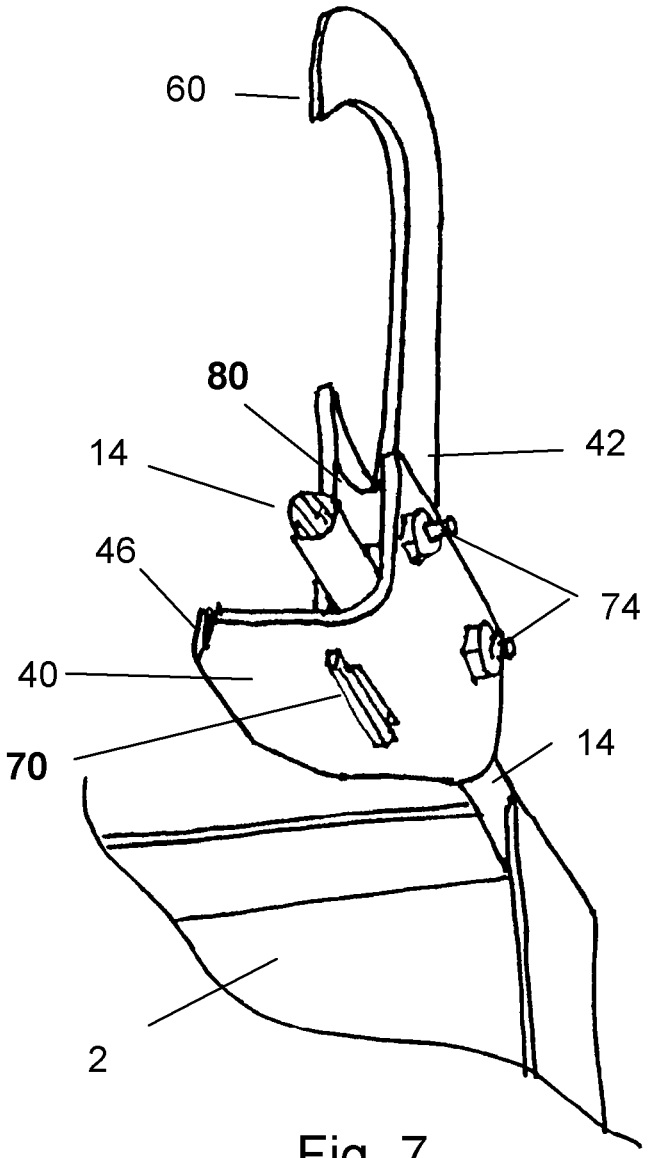
FIG. 7 is a perspective cutaway of the bracket in the second position.
Figure 8:
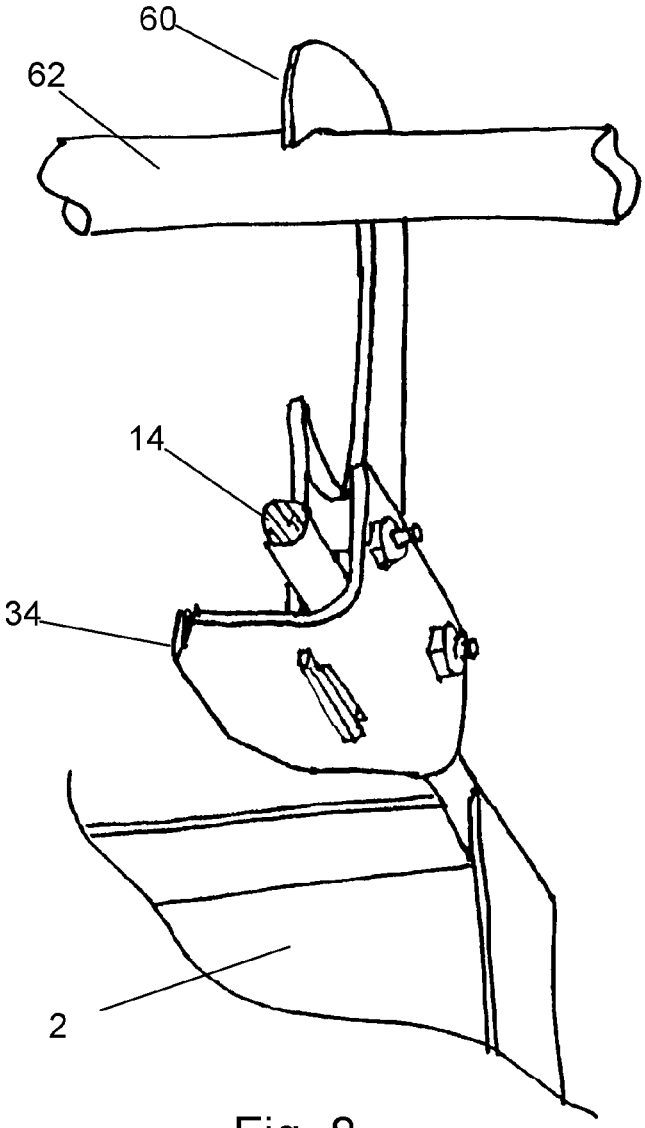
FIG. 8 is a perspective cutaway of the bracket in the second position and supporting the fan from an external support.
Figure 9:
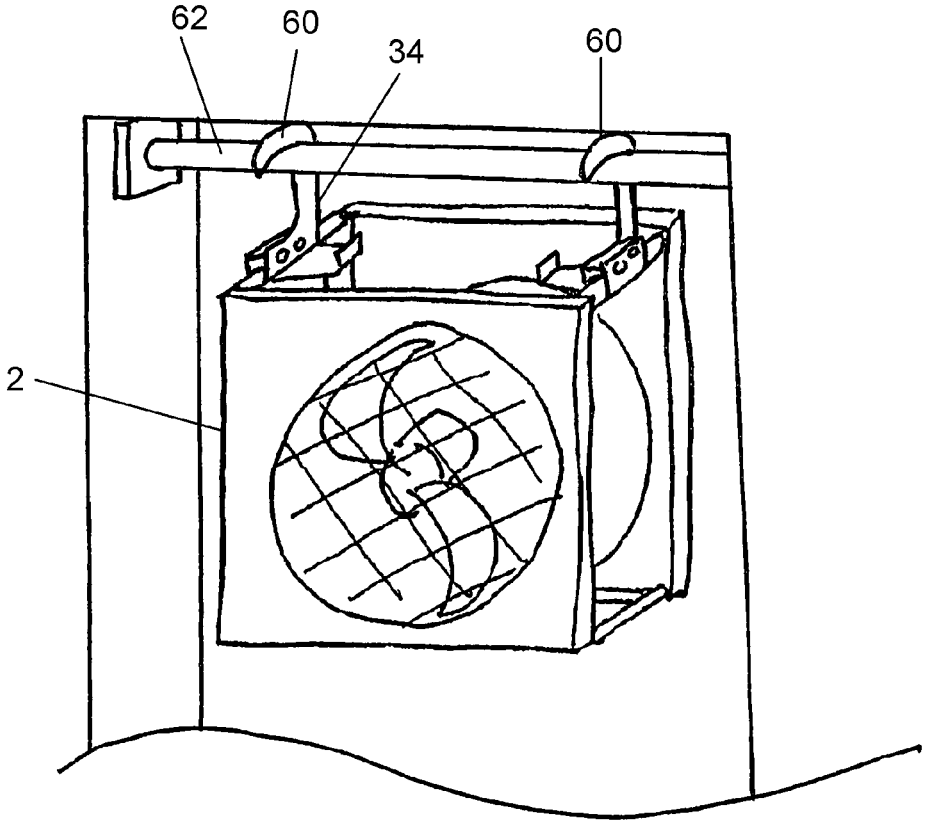
FIG. 9 is a perspective view of the bracket in the second position supporting the fan from an external support in a doorway.

FIGS. 3, 7, 8 and 9 illustrate the bracket 34 rotated about the bracket axis of rotation 44 to the second position. FIG. 3 is a perspective view of a fan 2 with the bracket 34 in the second position. The second arm 42 of the bracket 34 defines a hook 60. When the bracket 34 is rotated about the bracket axis of rotation 44 to the second position, the hook 60 extends upward from the fan 2. FIG. 7 is a detail cutaway view of the bracket 34 in the second position with the hook 60 extending upward from the fan 2. FIG. 8 includes an external support 62 by which the hook 60 supports the fan 2. FIG. 9 is a perspective view of the hooks 62 supporting the fan 2 in a doorway, illustrating that the fan 2 may be supported off the floor by any convenient external support 62.

Figure 10:
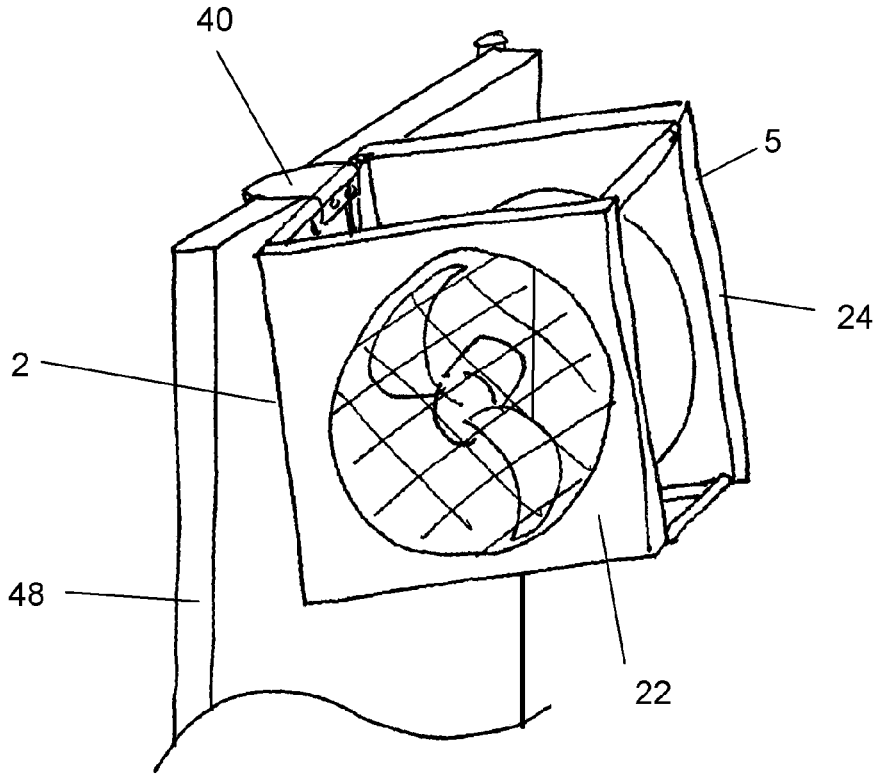
FIG. 10 is a perspective view of fan illustrating sliding adjustment of the bracket with respect to the center of gravity of the fan.

FIG. 10 illustrates that the brackets 34 not only rotatably engages the rod-shaped members 14, but also slidably engage the rod-shaped member 14. The brackets 34 may slide along the rod-shaped members 14 between the front side 22 and the back side 24 of the fan frame 5. Moving the bracket 34 toward the back side 24 of the frame 5 moves the center of gravity of the fan 2 forward with respect to the bracket 34. Moving the bracket 34 forward moves the center of gravity of the fan 2 rearward with respect to the bracket 34. Moving the bracket 34 forward tends to cause the fan 2 to tilt upward when the fan 2 is supported by the bracket 34. Moving the bracket 34 rearward tends to cause the fan to tilt downward when the fan is supported by the bracket 34. In FIG. 10, the bracket 34 is moved rearward and as a result the fan 2 is tilting downward.

Figure 11:
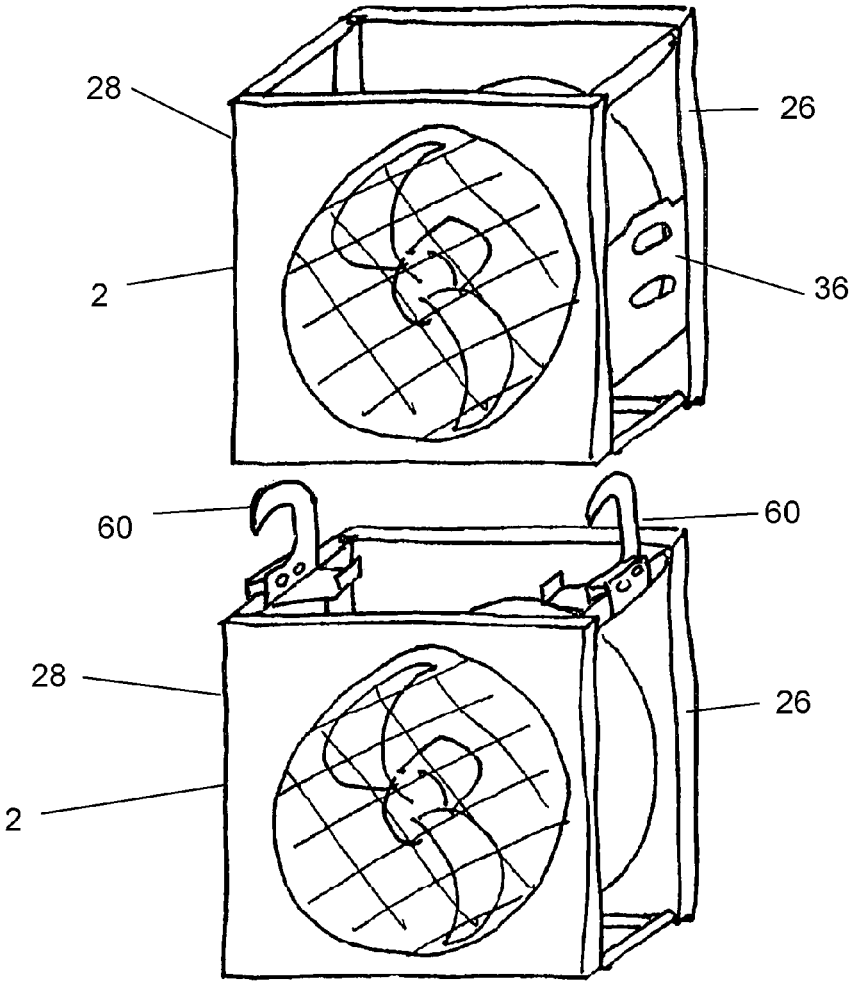
FIG. 11 is an exploded view of two stacked fans.

FIGS. 11, 12 and 13 illustrate the first and second systems of the Invention and illustrate use of the hooks 60 and matching stabilizing slots 66 to stabilize stacked fans 2. FIG. 11 is a perspective view of a second fan 2 in the process of being stacked upon a first fan 2. FIG. 12 is a detail cross section of the engagement of a hook 60 and a stabilizing slot 66 of two stacked fans 2. FIG. 13 is a side view of two stacked fans 2.

From FIGS. 11, 12 and 13, the second system of the Invention comprises a pair of side plates 36. The side plate is attached to the left and right sides 26, 28 of the fan 2. The side plate 36 includes one or more gripping locations 64. Each side plate 36 also includes a stabilizing slot 66. The gripping locations 64 are configured to be gripped by a firefighter so that the firefighter can carry the fan 2. The purpose of the stabilizing slots 66 is to allow a second fan to be stacked on top of a first fan by placing the bottom side of the first fan on top of the top side of the first fan. The stabilizing slots 66 are located so that when a pair of brackets 34 on the first fan 2 are placed in the second position with the hooks 60 extending upward from the first fan 2, the two stabilizing slots 66 of the second fan 2 align with the two hooks 60 so that the two hooks 60 penetrate the two stabilizing slots 66 when the bottom side 30 of the upper fan 2 engages the top side 32 of the lower fan 2. The engagement of the hooks 60 and the stabilizing slots 66 stabilizes the upper fan 2 when the upper and lower fans 2 are stacked.

FIGS. 4, 14 and 15 illustrate the brackets 34 in the third, or stowed, position. FIG. 4 is a perspective view of the fan 2 with the brackets 34 in the third position. FIG. 14 is a detail cutaway view of a bracket 34 in the third position. FIG. 15 is a detail section view of the bracket in the third position. In the third position, the first arm 40 is generally parallel to the side 26, 28 of the fan 2 and the second arm 42 is generally parallel to the top side 32 of the fan 2. The first and second arms 40, 42 substantially do not extend from the frame 5 of the frame 2. The third position is useful for moving and storing the fan 2. As illustrated by FIG. 4, the third position is also useful for retaining a coiled power cable 38 on top of the duct 8 so that both the cable 38 and the fan 2 may be moved or stored at the same time. To place the coiled cable 38 on the duct 8, the brackets 34 are placed in the second position, the coiled cable 38 is placed on the duct 8 and the brackets 34 are moved to the third position, retaining the coiled cable 38 on the duct 8.

FIGS. 16 through 23 illustrate components of the bracket 34. FIGS. 16 and 17 are two views of the second arm 42, which is composed of a metal plate, preferably aluminum. FIG. 16 is a side view of the second arm 42. FIG. 17 is an end view of the second arm 42. The second arm 42 defines a hook 68 and a key 70 at the end distal to the hook 68. Holes 72 are provided for fasteners 74.

FIGS. 18, 19 and 20 are the side, top, and end views of the first arm 40, respectively. From FIG. 19, the first arm 40 defines a bracket slot 76 and the door-engaging protrusion 46. The bracket slot 76 is configured to receive and retain the key 70 of the second arm 42, joining the first arm 40 and the second arm 42. Holes 72 accommodate fasteners 74 to attach the first and second arms 40, 42.

FIGS. 21, 22 and 23 show top, side and end views of a spacer 80. The spacer 80 is composed of nylon or other low-friction material.

To install the bracket 34 and as illustrated by FIG. 14, the key 70 of the second arm 42 penetrates and engages the bracket slot 76 of the first arm 40. The resulting combination of the first and second arms 40, 42 is placed in engagement with the rod-shaped member 14 and the spacer 80 is placed between the first and second arms 40, 42. Fasteners 74 penetrate the holes 72 in the first arm 40, spacer 80, and second arm 42, retaining the bracket 34 to the rod-shaped member 14. The frictional engagement of the bracket 34 and the rod-shaped member 14 is determined by the degree of force applied by the fasteners 74 clamping the first and second arms 40, 42 and the spacer 80, which determines the ease with which the bracket 34 may be rotated between the three positions and the ease with which the bracket 34 may slide along the rod-shaped member 14 between the front side 22 and the back side 24 of the fan 2.

FIGS. 16 through 23 illustrate one possible configuration of the bracket 34. Any other configuration of the bracket 34 that has two arms and is capable of being rotated between at least two positions, as described above, is contemplated by the Invention.

FIGS. 24, 25 and 26 are three views of the side plates 36. FIG. 25 is a plan view. FIG. 24 is an end view and FIG. 26 is a side view. Side plates 36 are mounted to the left and right sides 26, 28 of the fan 2. The side plates include one or more gripping locations 64 by which a firefighter may grip and hold the fan 2 to move the fan 2. The end of the side plate 36, shown by FIG. 24, defines a stabilizing slot 66. As described above, the stabilizing slot 66 of an upper fan 2 receives the second arm 42 of a bracket 34 of a second fan 2 to allow the fans 2 to be stacked one on top of the other. FIGS. 24 through 26 illustrate one possible configuration of the side plate 36. The configuration of FIGS. 24 through 26 is suitable for retrofitting a prior art fan 2. Any other configuration of the fan 2 that provides stabilizing slots 66 that align with the second arm 42 of a bracket of another fan 2 is contemplated by the Invention.

FIGS. 27 through 33 illustrate the operation and construction of extendable bars 82, which comprise the third system of the invention. FIG. 27 through 30 are perspective views of a fan 2 with extendable bars 82 installed. The extendable bars 82 are shown in FIG. 20 in the stowed position. In FIG. 28, the extendable bars 82 are shown in the process of extending and are rotated about hinges 84. In FIG. 29, the extendable bars 82 are shown in the fully deployed position. The extendable bars are first, second, third and fourth extendable bars 86, 88, 90, 92. The extendable bars 82 may be secured in both the stowed and deployed positions by clevis pins 94 or by any other suitable apparatus known in the art.

As shown by FIG. 30, in the deployed position the extendable bars 82 may support the fan 2 in a window sill or doorway, with the bars 82 extending on the outside and the inside of the wall 96 defining the window sill or doorway, as is shown by FIGS. 30, 31 and 32.

FIG. 31 is a detail cutaway of the hinge end of an extendable bar 82 and channel 98 in the stowed position. FIG. 32 is a detail cutaway of the hinge end of the extendable bar 82 and channel 98 in the deployed position. The bar 82 rotates about hinge 84. The bar 82 is secured in the deployed position by clevis pins 94. FIG. 33 is a detail view of the end opposite to the hinge 84 in the stowed position. In the example of FIG. 33, the extendable bars 82 are the first extendable bar 86 and the third extendable bar 90. The extendable bars 86, 90 are retained in the stowed position by clevis pins 94. Any other configuration of the extendable bars 82 known in the art is contemplated by the Invention, including extendable bars 82 that slide laterally from the sides 26, 28 of the fan 2, bars 82 that telescope, bars 82 that are disposed against the sides 26, 28 of the fan 2 when in the stored position, any other configuration that allows the bars 82 to be disposed on both sides of a wall 96 when the fan 2 is placed on a window sill and the bars 82 are placed in the deployed position.

For the kit of the invention, the brackets 34, side plates 36 and extendable bars 82 are configured to be attached to the fan 2. For the fan 2 of the invention, the fan 2 may incorporate the brackets 34, extendable bars 82 and stabilizing slots 66 into the body 5 of the fan 2.

The method of the Invention for utilizing the brackets 34 is illustrated by FIG. 34 and includes the following steps where the method is utilizing the kit of the Invention. The first step 100 is providing a fan 2, followed by the step 102 of mounting the brackets 34 and side plates 36 to the fan 2. To support the fan 2 from a door 48, a firefighter will place the bracket 34 in the first position (step 104) and place the door-engaging protrusion 46 in engagement with the back side 54 of the door 48 (step 106). The firefighter will allow the door 48 to support the weight of the fan 2, clamping the fan 2 to the front side 52 of the door 48. Because the bracket 34 is self-supporting in each of the three positions, the task of hanging the fan 2 from a door 48 is a one-person job, unlike the prior art. To hang the fan 2 from an external support 62, such as a prior art extendable arm, the firefighter will place the bracket 34 in the second position (step 110) and will hang the hook 60 from the external support 62 (step 112). To store a coiled cable 38 on the cylindrical duct 8 of the fan 2, the firefighter will place the coiled cable 38 on the cylindrical duct 8 (step 114) and will rotate the brackets 34 to the third position (step 116), retaining the cable 38 on the duct 8. The method of using the fan 2 of the Invention is the same as the method of utilizing the kit, except that the step of installing the kit is not required.

The method of utilizing the extendable bars 82 is shown by FIG. 35. The first step 100 is providing the fan 2, followed by the step 118 of installing the extendable bars. The firefighter then places the fan 2 on a windowsill of an open window or in an open doorway (step 120). The firefighter moves two of the extendable bars 82 to the deployed position on the inside of the wall 96 defining the window or doorway (step 122) and moves two extendable bars 82 to the deployed position on the outside of the wall 96 defining the window or doorway (step 124). The method of using the fan 2 of the invention is the same, but with step 118 of installing the extendable bars deleted.

Numbered Elements fan 2
blade 4,
fan frame 5
electrical motor 6 cylindrical duct 8
intake baffle 10
exhaust baffle 12.
Rod-shaped members 14
Grills 16
fan axis of rotation 20
front side 22
back side 24
left side 26
right side 28
bottom side 30
top side 32
bracket 34
side plates 36
coiled electrical cable 38
first arm 40
second arm 42
bracket axis of rotation 44
a door engaging protrusion 46
door 48
thickness of a door 50
front side of said door 52
back side of the door 54
tops side of the door 56
door hinge 58
hook 60
external support 62
gripping location 64
stabilizing slot 66
hook 68
key 70
holes 72
fasteners 74
bracket slot 76
spacer 80
extendable bar 82
hinges 84
first extendable bar 86
second extendable bar 88
third extendable bar 90
fourth extendable bar 92
clevis pin 94
wall 96
channel 98

I claim:

1. A firefighter's fan apparatus, the apparatus comprising:

a. a fan;

b. a bracket attached to said fan, said bracket defining a first arm and a second arm, said second arm being generally normal to said first arm, said bracket defining an axis of rotation, said bracket being rotatable with respect to said fan about said axis of rotation between a first and a second position, said first arm extending laterally from said fan when said bracket is in said first position;

c. a door engaging protrusion, said door engaging protrusion being defined by said first arm, said door engaging protrusion being generally parallel to said second arm and in a spaced-apart relation to said second arm, said spaced-apart relation corresponding to a thickness of a door, whereby when said bracket is in said first position and said door-engaging protrusion is placed in engagement with a back side of said door, a weight of said fan causes said bracket to rotate about said axis of rotation, forcing said second arm against a front side of said door, clamping said door between said door-engaging protrusion and said second arm, thereby clamping said fan to said door; and wherein said second arm defines a hook and wherein said hook extends from said fan when said bracket is in said second position, whereby said hook may hang from an external support to support said fan when said bracket is in said second position.

2. The apparatus of claim 1 wherein said first arm does not extend from said fan when said arm is in said second position.

3. The apparatus of claim 2 wherein said bracket is rotatable about said axis of rotation to a third position, neither said first arm nor said second arm protruding from said fan when said bracket is in said third position, whereby said hook and said door engaging protrusion are stowed when said bracket is in said third position.

4. The apparatus of claim 3 wherein said bracket is a first bracket of a pair of brackets, the apparatus further comprising: a second bracket, said first and said second brackets being rotatably attached to said fan proximal to opposing sides of said fan, said second bracket being generally a mirror image of said first bracket, whereby either of said opposing sides of said fan may be clamped to said door by said first or said second brackets when said first or said second brackets is in the first position and whereby said hooks of said first and said second brackets may hang from said external support when said first and said second brackets are in said second position.

5. The apparatus of claim 4 wherein said fan comprises an axial fan blade having a fan axis of rotation, said axis of rotation of said first and said second brackets being generally parallel to said fan axis of rotation.

6. The apparatus of claim 4 wherein said fan is a first of a pair of said fans, a second fan of said pair of fans having a pair of said brackets having a pair of said hooks, said first fan having a fan frame, said fan frame having a top side and a bottom side, said fan frame defining a pair of stabilizing slots proximal to said bottom side, said pair of stabilizing slots being configured to receive said pair of said hooks of said second of said pair of fans when said brackets of said second fan are in said second position and said bottom side of said fan frame is placed in engagement with said top side of said second fan, whereby said pair of fans may be stacked.

7. A kit for retrofitting a firefighter's fan, the firefighter's fan having a frame defining a front side and a back side, a top side and a bottom side, a left side and a right side, the frame defining four rod-shaped members, the four rod-shaped members joining the front and back sides of the rectangular frame, two of the rod-shaped members being proximal to the top side and two of said rod shaped handles being proximal to the bottom side, each of the rod-shaped members defining a longitudinal axis, the kit comprising:

a. a bracket, said bracket being attachable to one of said four rod-shaped members;

b. a first arm and a second arm defined by said bracket, said second arm being fixed with respect to said first arm and generally normal to said first arm;

c. said bracket defining an axis of rotation when said bracket is attached to the rod-shaped member, said axis of rotation corresponding to the longitudinal axis of the rod-shaped member to which said bracket is attached, said bracket being rotatable with respect to the fan about said axis of rotation between a first and a second position, said first arm extending laterally from said fan when said bracket is attached to the rod-shaped member and said bracket is in said first position;

d. a door engaging protrusion, said door engaging protrusion being defined by said first arm, said door engaging protrusion being generally parallel to said second arm and in a spaced-apart relation to said second arm, said spaced-apart relation corresponding to a thickness of a door, whereby said bracket is configured so that when said bracket is attached to said rod-shaped member and is in said first position and said door-engaging protrusion is placed in engagement with a back side of said door, a weight of said fan causes said bracket to rotate about said axis of rotation, forcing said second arm against a front side of said door, clamping said door between said door-engaging protrusion and said second arm, thereby clamping said fan to said door; and wherein said second arm defines a hook and wherein said hook extends from said fan when said bracket is attached to the rod-shaped member and is in said second position, whereby said hook is configured so that said hook may hang from an external support to support said fan when said bracket is in said second position.

8. The kit of claim 7 wherein said first does not extend from the fan when said bracket is attached to the rod-shaped member and said arm is in said second position.

9. The kit of claim 8 wherein said bracket is rotatable about said axis of rotation to a third position when said bracket is attached to the rod-shaped member, neither said first arm nor said second arm protruding from said fan when said bracket is in said third position, whereby said hook and said door engaging protrusion are stowed when said bracket is in said third position.

10. The kit of claim 8 wherein said bracket is a first bracket of a pair of brackets, the kit further comprising:

a. a second bracket, said second bracket defining a first arm and a second arm that is fixedly attached generally normal to said first arm, said second bracket defining a second bracket axis of rotation, said second bracket being rotatable with respect to said fan about said second bracket axis of rotation between said first and said second position when said second bracket is attached to one of the rod-shaped members, said first arm of said second bracket extending laterally from said fan when said second bracket is in said first position;

c. a second door engaging protrusion, said second door engaging protrusion being defined by said first arm of said second bracket, said door engaging protrusion being generally parallel to said second arm of said second bracket and in a spaced-apart relation to said second arm of said second bracket, said spaced-apart relation corresponding to said thickness of said door, whereby said first and said second bracket are configured so that when either said first or said second bracket is attached to one of the rod-shaped members and in said first position and said first or said second door-engaging protrusion is placed in engagement with said back side of said door, said weight of said fan causes said first or said second bracket to rotate about said first or said second bracket axis of rotation, forcing said first or said second arm of said first or said second bracket against said front side of said door, clamping said door between said door-engaging protrusion and said second arm of said first or said second bracket, thereby clamping said fan to said door.

11. The kit of claim 10 wherein said second arm of said second bracket defines a second hook, said second hook extends from said fan when said second bracket is attached to one of the rod-shaped members and is in said second position, whereby said second bracket is configured so that said second hook may hang from an external support to support said fan when said second bracket is attached to one of the rod-shaped members and is in said second position.

12. The kit of claim 11, the kit further comprising:

a. a pair of side plates, said pair of side plates being attachable to the left side and the right side of the frame, each of said side plates providing a gripping location when said side plates are attached to the left and right sides of the frame;

b. a pair of stabilizing slots, a one of said pair of stabilizing slot being defined by each of the side plates, said pair of stabilizing slots being proximal to the bottom side of the frame when said pair of side plates are attached to the left and right sides of the frame, each of said stabilizing slots being configured to slidably engage said hook and said second hook installed on a second fan and in said second position, whereby said hooks and said stabilizing slots are configured so that two fans may be stacked and retained in position by said engagement of said hooks and said stabilizing slots.

13. The kit of claim 12 wherein each of said pair of side plates provides a plurality of gripping locations, said gripping locations being located intermediate to said rod-shaped members on said left and said right sides of said frame when said pair of side plates is attached to said frame.

14. The kit of claim 7 wherein said bracket comprises:

a. a first arm, said first arm defining a bracket slot, said first arm defining said first arm;

b. a second arm, said second arm defining a key, said key being configured to penetrate and be engaged by said bracket slot;

c. a spacer, said spacer being disposed between said first arm and said second arm when said bracket is attached to said rod-shaped member; and d. a fastener, said fastener being configured to attach said first arm, said second arm and said spacer.

15. A method of supporting a firefighter's fan, the method comprising the following steps:

a. providing a firefighter's fan, said fan having a bracket attached to said fan, said bracket defining a first arm and a second arm, said second arm being generally normal to said first arm, said first arm defining a door engaging protrusion, said door engaging protrusion being generally parallel to said second arm and in a spaced-apart relation to said second arm, said spaced-apart relation corresponding to a thickness of a door, said bracket defining an axis of rotation, said bracket being rotatable with respect to said fan about said axis of rotation between a first and a second position, said first arm extending laterally from said fan when said bracket is in said first position;

b. placing said bracket in said first position;

c. placing said door-engaging protrusion in engagement with a back side of said door;

d. allowing said door to support a weight of said fan, whereby said bracket is configured so that said weight of said fan causes said bracket to rotate about said axis of rotation, forcing said second arm against a front side of said door, clamping said door between said door-engaging protrusion and said second arm, thereby clamping said fan to said door; and wherein said second arm defines a hook and wherein said hook extends from said fan when said bracket is in said second position, the method further comprising: e. placing said bracket in said second position; f. hanging said hook from a support to support said fan.

16. The method of claim 15 wherein said first arm does not extend from said fan when said arm is in said second position.

17. The method of claim 16 wherein said bracket is rotatable about said axis of rotation to a third position, neither said first arm nor said second arm protruding from said fan when said bracket is in said third position, the method further comprising: placing said bracket in said third position, whereby said hook and said door engaging protrusion are stowed when said bracket is in said third position.

* * * * *